US006830241B1

(12) United States Patent
Klopfenstein

(10) Patent No.: US 6,830,241 B1
(45) Date of Patent: Dec. 14, 2004

(54) POCKET ASSEMBLY FORMING DIFFERENT SIZE ASSEMBLAGES

(75) Inventor: Andrew L. Klopfenstein, Cornwall, NY (US)

(73) Assignee: K & M Newspaper Services, Inc., Monroe, NY (US)

( * ) Notice: Subject to any disclaimer, the term of this patent is extended or adjusted under 35 U.S.C. 154(b) by 0 days.

(21) Appl. No.: 10/630,209

(22) Filed: Jul. 30, 2003

(51) Int. Cl.[7] ..... B65H 5/30

(52) U.S. Cl. ..... 270/52.25; 270/52.23; 270/52.19

(58) Field of Search ..... 270/52.23, 52.24, 270/52.25, 52.14, 52.19

(56) References Cited

U.S. PATENT DOCUMENTS 4,046,367 A * 9/1977 Merker et al. ..... 270/52.24
4,124,203 A * 11/1978 Muller ..... 270/52.2
4,723,770 A * 2/1988 Seidel et al. ..... 270/52.2
5,065,994 A * 11/1991 Hatt ..... 270/52.23
5,112,036 A * 5/1992 Hatt ..... 270/52.23
5,269,504 A * 12/1993 Backman ..... 270/52.2
5,527,025 A 6/1996 Schlough
5,911,416 A * 6/1999 Klopfenstein ..... 271/223
6,234,466 B1 * 5/2001 Infanger ..... 270/52.23
6,311,968 B1 * 11/2001 Linder et al. ..... 270/52.25
6,612,567 B1 * 9/2003 Kaya ..... 271/206
6,691,966 B1 * 2/2004 Schwarz et al. ..... 248/276.1

* cited by examiner

*Primary Examiner*—Patrick Mackey
(74) *Attorney, Agent, or Firm*—Tarolli, Sundheim, Covell & Tummino L.L.P.

(57) ABSTRACT

An apparatus for use in forming sheet material assemblages includes a pocket assembly having upper and lower grippers. The upper gripper is spaced a first distance from a sheet material support portion of the pocket assembly to engage an upper edge portion of a large cover section having a relatively large distance between a fold and an upper edge portion. The lower gripper is spaced a distance which is smaller than the first distance from the sheet material support portion of the pocket assembly to engage an upper edge portion of a small cover section having a relatively small distance between a fold and an upper edge portion of the cover section. Pressers are mounted on a movable side wall of the pocket assembly and are engagable with a side of a small cover section to press small the cover section toward the lower gripper.

24 Claims, 6 Drawing Sheets

POCKET ASSEMBLY FORMING DIFFERENT SIZE ASSEMBLAGES

BACKGROUND OF THE INVENTION

The present invention relates to a pocket assembly which is utilized in forming sheet material assemblages of different sizes.

A known apparatus for use in forming sheet material assemblages, such as newspapers, includes a plurality of pocket assemblies which are moved past a plurality of sheet material feed mechanisms. A first one of the sheet material feed mechanisms feeds a cover section into the pocket assembly. Subsequent sheet material feed mechanisms feed sheet material items into the cover section.

When a cover section is fed into a pocket assembly, the folded edge of the cover section registers against the bottom of the pocket assembly. This causes the upper edge of the cover section to be at a height which is dependent upon the height of the cover section. A relatively tall cover section for a broad sheet product, has an upper or cut edge portion which is engaged for a broad sheet product, has an upper or cut edge portion which is engaged by a gripper. Similarly, a relatively short cover section for a quarter fold product, has a cut or upper edge portion which is engaged by the same gripper. To compensate for cover sections or jackets of different heights, adjustable pocket assemblies have been provided in the manner disclosed in U.S. Pat. Nos. 5,527,025 and 5,911,416.

SUMMARY OF THE INVENTION

The present invention relates to a new and improved apparatus for use in forming sheet material assemblages of different heights. The sheet material assemblages include a folded cover section into which other sheet material items are inserted. The cover sections for tall sheet material assemblages have a greater height than the cover sections for short sheet material assemblages.

The apparatus includes a pocket assembly which is sequentially movable past a plurality of sheet material of feeders. The pocket assembly includes an upper gripper for gripping a tall cover section and a lower gripper for gripping a short cover section. The upper gripper is spaced further from a bottom of the pocket assembly than is the lower gripper.

It should be understood that the present invention includes a plurality of different features. These features may be used in association with each other in the manner disclosed in the present application. Alternatively, the features may be used separately or in combination with features of the prior art.

BRIEF DESCRIPTION OF THE DRAWINGS

The foregoing and other features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
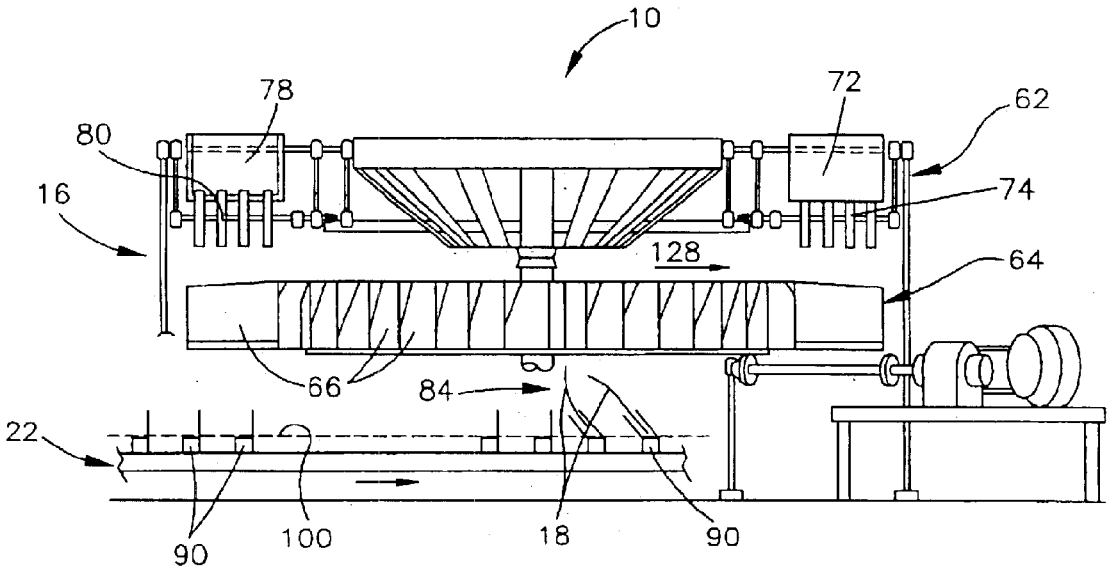
FIG. 1. is a schematic elevational view of a sheet material handling apparatus having an array of sheet material feeders, a movable array of pocket assemblies, and a delivery conveyor.

A sheet material handling apparatus 10 (FIG. 1) forms sheet material assemblages and transports them to a receiving station. The sheet material handling apparatus 10 includes a collator conveyor assembly 16 which is operable to form sheet material assemblages 18. A delivery conveyor 22 and conveyor assembly 16 transports the assemblages 18 to a receiving station (not shown). The delivery conveyor 22 is shown as a gripper conveyor but could be any suitable type of conveyor.

Although the sheet material assemblages 18 could take many different forms, the sheet material assemblages 18 are shown as newspapers. Each of the newspapers 18 has a either a relatively large jacket or folded outer cover section 28 (FIG. 2) or a relatively small jacket or folded outer cover section 30. Inner sections or sheet material items are stuffed into the open cover sections during operation of the collator conveyor assembly 16.

A relatively large outer cover section 28 has a folded or closed lower edge portion 32 and cut or open upper edge portion 34. A front headline side or section 36 extends between the folded lower edge portion 32 and the open upper edge portion 34. Similarly, a back side or section 38 extends between the folded edge portion 32 and the upper edge portion 34. During operation of the collator conveyor assembly 16, sheet material items, that is, inner sections of a newspaper, are inserted into the open cover section 28 in the manner indicated schematically by the arrow 40 in FIG. 2.

The back section 38 of the cover section 28 is taller than the front section 36. Therefore, the upper edge portion 34 of the front section 36 is disposed below the upper edge portion 34 of the back section 38. This results in the cover section 28 having a lapped construction. If desired, the front section 36 may be taller than the back section 38 to reverse the lapped construction of the cover section 28. The cover section 28 has a relatively large height, that is, the distance from the folded lower edge portion 32 to the upper edge portion 34 as measured in a direction perpendicular to the folded edge portion 32.

The smaller cover section 30 (FIG. 2) has a construction which is generally similar to the construction of the larger cover section 28. Thus, the relatively small cover section 30 includes a folded or closed lower edge portion 42 and cut or open edge portions 44. However, the cover section 30 has a relatively small height, that is, the distance from the folded lower edge portion 42 to the upper edge portion 44 as measured in a direction perpendicular to the folded edge portion.

A front, headline side or section 46 of the cover section 30 extends between the folded lower edge portion 42 and the open upper edge portion 44. Similarly, a back side or section 48 extends between the lower edge portion 42 and the upper edge portion 44. During operation of the collator conveyor assembly 16, sheet material items, that is, inner sections of newspapers, are fed into the cover section 30 in the manner indicated schematically by the arrow 50 in FIG. 2.

The back section 48 of the cover section 30 is taller than the front or headline section 46. Therefore, the upper edge portion 44 of the headline section 46 is disposed below the upper edge portion of the back section 48. This results in the cover section 30 having a lapped construction. If desired, the front section 46 may be taller than the back section 48 to reverse the lapped construction of the cover section 30.

Since the sheet material assemblages 18 (FIG. 1) are newspapers, the illustrated collator conveyor assembly 16 is a known newspaper stuffing or assembly machine. It should be understood that the present invention may be used with collator conveyor assemblies having constructions which are different than the construction of the collator conveyor assembly 16.

The collator conveyor assembly 16 (FIG. 1) includes a circular stationary sheet material in feed mechanism 62 which is disposed directly above and is coaxial with a movable circular rotor or collator conveyor 64 having a plurality of identical pocket assemblies 66. The sheet material in feed mechanism 62 includes a jacket or cover section feed hopper 72 in which a plurality of either the relatively large cover sections 28 (FIG. 2) or the relatively small cover sections 30 may be disposed. The cover sections 28 or 30 are sequentially fed from the stationary cover section hopper 72 (FIG. 1) into pocket assemblies 66 of the circular collator conveyor 64 by a sheet material feed mechanism 74. The cover sections 28 or 30 are fed into the pocket assemblies 66 with the relatively short headline side 36 or 46 of the cover sections facing rearward, that is, in a direction opposite to the direction of movement of the pocket assemblies 66.

As the collator conveyor 64 moves the circular array of pockets 66, sheet material items or inner sections are fed from item feed hoppers 78 by sheet feed mechanisms 80. Although only a single item feed hopper 78 is illustrated in FIG. 1, it should be understood that there are a plurality of item feed hoppers disposed in an arcuate array above the rotor or collator conveyor 64. The arcuate array of item feed hoppers 78 has its center of curvature disposed on the axis of rotation of the collator conveyor 64.

As each of the pocket assemblies 66 moves through a discharge station 84, the lower end of the pocket assembly 66 is opened. As the pocket 66 opens, a newspaper is dropped from the pocket assembly downward to the delivery conveyor 22. The general manner in which the collator conveyor assembly 16 is constructed and operated is known. Although a specific collator conveyor assembly 16 having a circular construction has been illustrated herein, the collator conveyor assembly could have a different construction if desired. For example, the collator conveyor assembly 16 could have a linear and/or oval construction.

The delivery conveyor 22 as illustrated includes a plurality of identical grippers 90 which are interconnected by a conveyor chain indicated schematically at 100 in FIG. 1. The conveyor chain 100 is moving at a constant speed and extends in a continuous loop from the discharge, station 84 to the receiving station and back to the discharge station. The delivery conveyor 22 extends between the discharge station 84 and a receiving station.

The grippers 90 are sequentially closed to engage newspapers at the discharge station 84 while the newspapers are being transported by the rotor 64. The grippers 90 may have any desired construction. It should be understood that the delivery conveyor 22 may have a different construction if desired. For example, the delivery conveyor 22 may include one or more belts which receive newspapers from the rotor 64 of the collator conveyor 16 at the discharge station 84.

Pocket Assembly

Each of the pocket assemblies 66 (FIG. 1) is constructed in accordance with the present invention. Each of the pocket assemblies 66 is capable of being used to form sheet material assemblages having either relatively tall jacket or cover section 28 (FIG. 2) or the relatively short jacket or cover section 30 without being adjusted. To enable the pocket assembly 66 to be utilized with either the cover section 28 having a relatively tall height or the cover section 30 having a relatively short height, the pocket assembly 66 (FIG. 3) has a plurality of grippers which are engagable with upper edge portions of the cover sections. A main or upper gripper 110 is engagable with cut upper edge portion 34 of the back section or side 38 of a relatively tall jacket or cover section 28. A secondary or lower gripper 112 is engagable with a cut upper edge portion 44 of the back section or side 48 of a relatively short jacket section 30.

When a relatively large jacket or cover section 28 is being utilized, the main or upper gripper 110 (FIG. 3) is effective to grip the back section or side 38 (FIG. 2) of the cover section 28. At this time, the lower gripper 112 (FIG. 3) does not grip any part of the relatively large folded cover section 28. Similarly, when the relatively small folded cover section 30 is being utilized, the second or lower gripper 112 (FIG. 3) is effective to grip the back section or side 48 (FIG. 2) of the relatively small cover section 30. At this time, the main or upper gripper 110 does not grip any part of the relatively small cover section 30.

Figure 2:
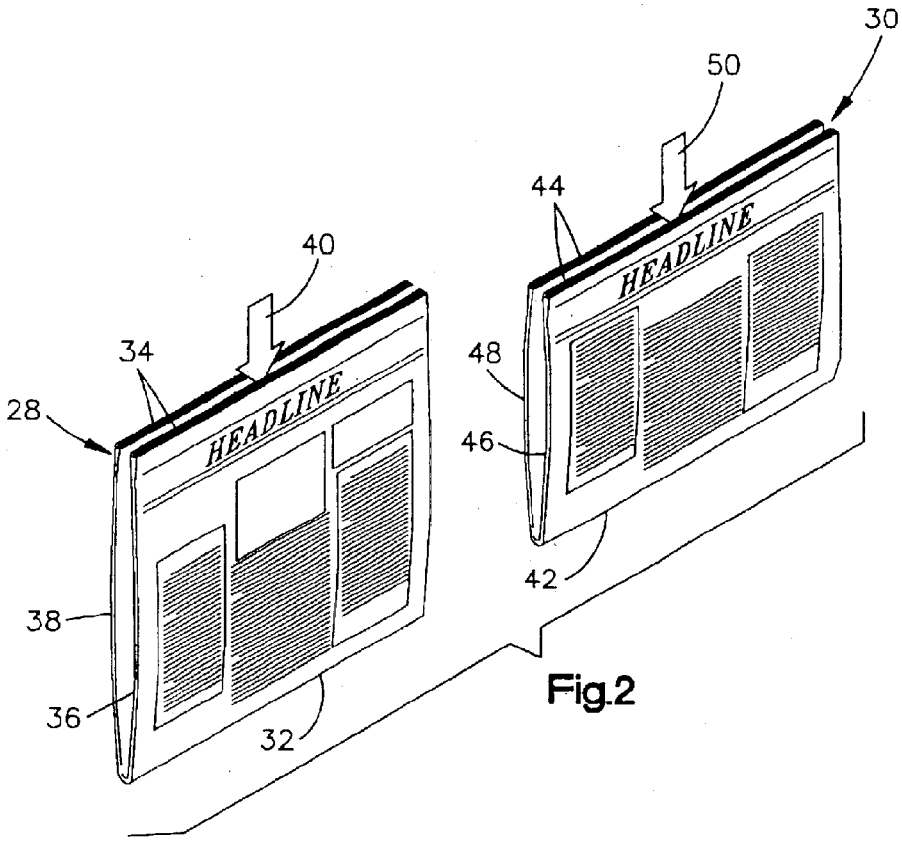
FIG. 2. is a schematic illustration of the manner in which inserts are fed into an open cover section having a relatively large height by the sheet material handling apparatus of FIG. 1 and the manner in which inserts are fed into an open cover section having a relatively small height by the sheet material handling apparatus of FIG. 1.
Figure 3:
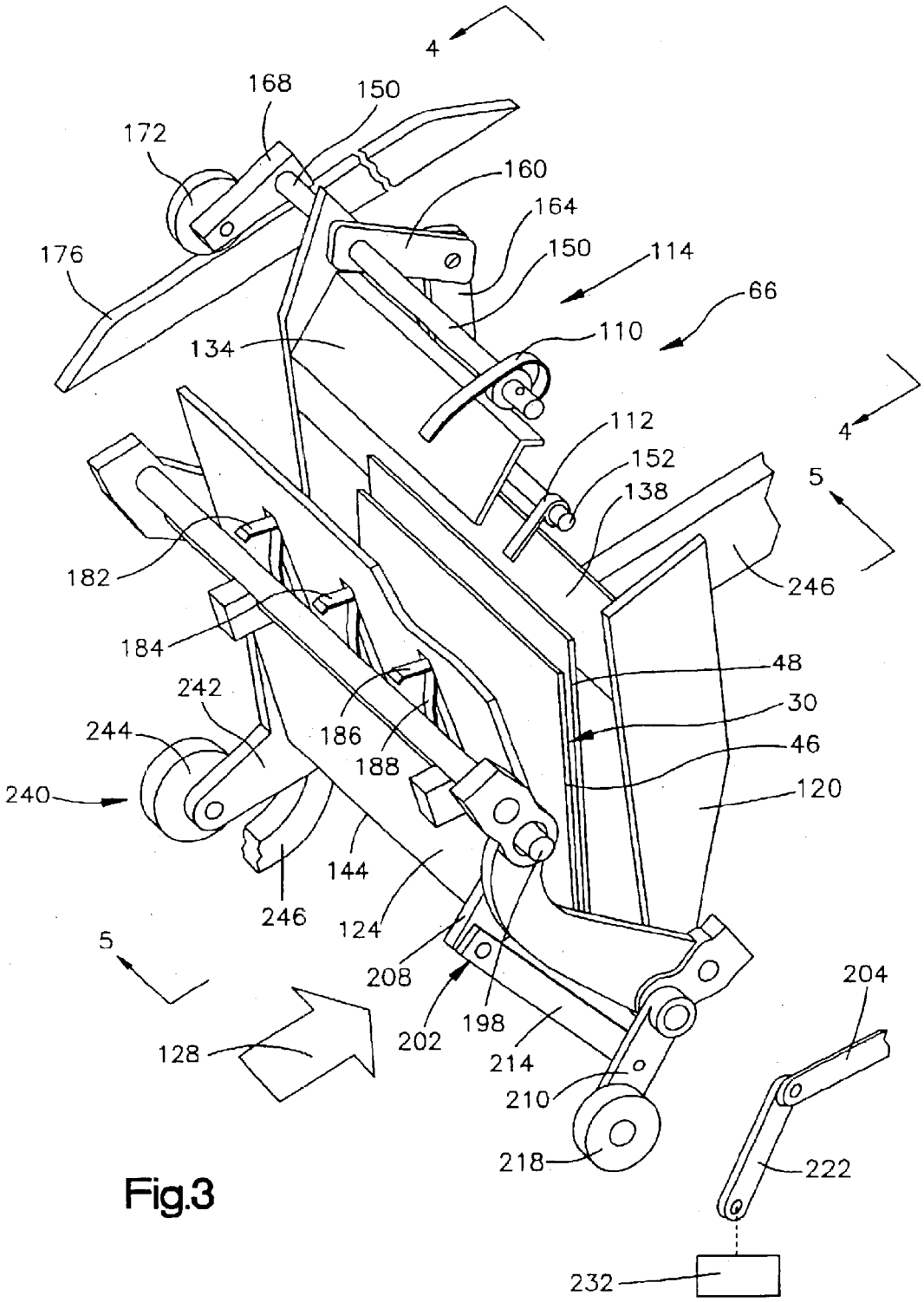
FIG. 3. is a fragmentary simplified schematic illustration of a pocket assembly used in the sheet material handling apparatus of FIG. 1 and constructed in accordance with the present invention.
Figure 4:
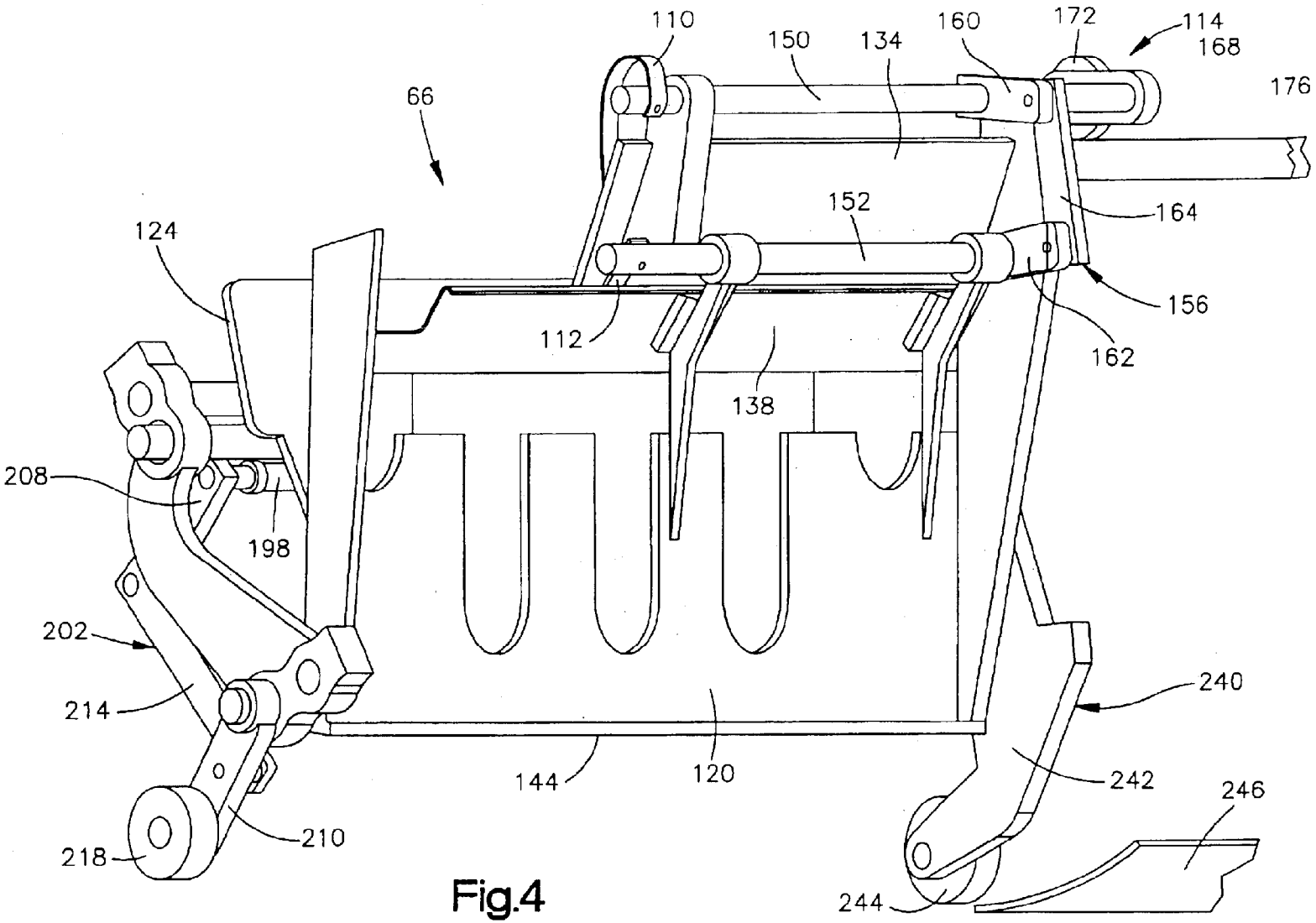
FIG. 4. is a simplified schematic rear plan view, taken generally along the line 4—4 of FIG. 3, illustrating the relationship of a gripper operating assembly to grippers and to a main or forward wall of the pocket assembly.

Although only one of the two grippers 110 and 112 is effective to grip a cover section 28 or 30, both grippers are simultaneously operated between open and closed conditions by a gripper operator assembly 114 (FIGS. 3 and 4). Therefore, either a relatively large cover section 28 (FIG. 2) or a relatively small cover section 30 may be fed from the cover section hopper 72 (FIG. 1) into the pocket assembly 66.

If desired, the gripper operator assembly 114 may be constructed so as to operate only one of the grippers 110 and 112 at a time. This would result in operation of only the gripper 110 or 112 which is effective to engage the upper portion of a cover section fed from the cover section hopper 72. If this is done, only the main gripper 110 would be operated from an open condition to a closed condition to grip the upper portion of the relatively large jacket. Similarly, only the lower gripper 112 would be operated to grip the upper portion of the relatively small jacket or cover section 30. Such a construction may require adjusting the gripper operator assembly 114 to actuate the desired gripper 110 or 112. By simultaneously operating both grippers 110 and 112, the illustrated embodiment of the pocket assembly 66 may be used in association with either a relatively large cover section 28 or a relatively small cover section 30 without adjusting the pocket assembly.

The pocket assembly 66 (FIGS. 3 and 4) includes a main or forward wall 120 which forms a base for the pocket assembly. The main or forward wall 120 is connected with a frame of the collator conveyor rotor 64 (FIG. 1). The main or forward wall 120 (FIGS. 3 and 4) of the pocket assembly 66 moves with the frame of the collator conveyor rotor 64 about the central axis of the collator conveyor assembly 16.

Figure 5:
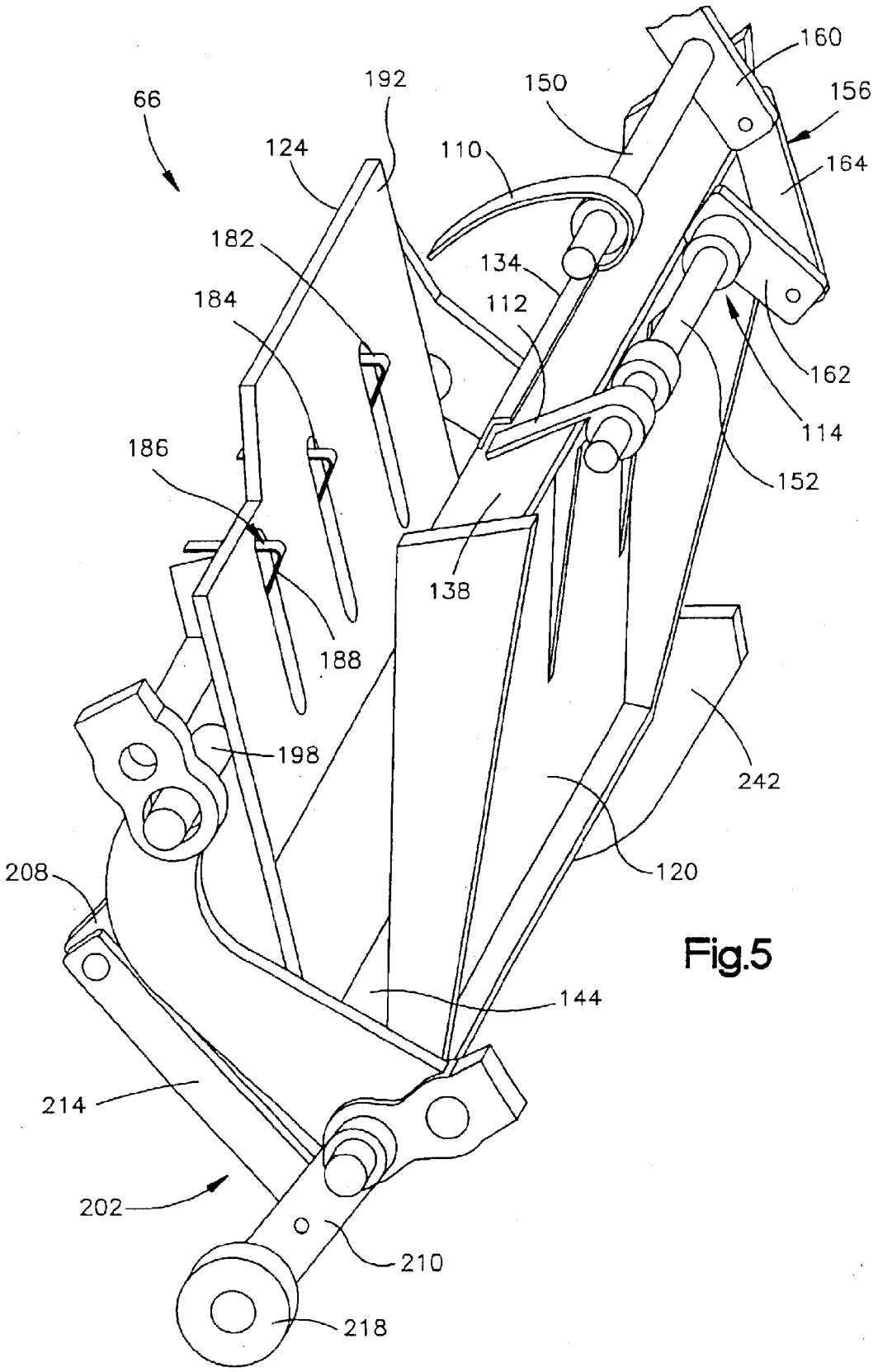
FIG. 5. is a fragmentary simplified schematic pictorial illustration, taken generally along the line 5—5 of FIG. 3, of the pocket assembly and depicting the relationship between a plurality of presser members and a movable rearward wall of the pocket assembly.

The pocket assembly 66 also includes a secondary or rearward wall 124 (FIGS. 3 and 5). The rearward wall 124 is movable toward and away from the main or forward wall 120. During movement of the secondary or rearward wall 124 relative to the forward wall, the rearward wall may be pivoted about an axis adjacent to a lower end portion of the pocket assembly 66. When the secondary or rearward wall 124 is pivoted about an axis adjacent to the lower end portion of the pocket assembly 66, the rearward wall is moved relative to the main wall 120 between the upwardly opening condition illustrated in FIGS. 3–5 and the closed condition illustrated in FIG. 6.

When the rearward wall 124 is in the upwardly opening condition, a cover section 28 or 30 may be fed into the open pocket assembly 66 from the cover section hopper 72 (FIG. 1). As the rearward wall 124 is operated to the closed condition of FIG. 6, the gripper 110 or 112 is effective to grip the upper end portion of either the cover section 28 or the cover section 30.

Figure 6:
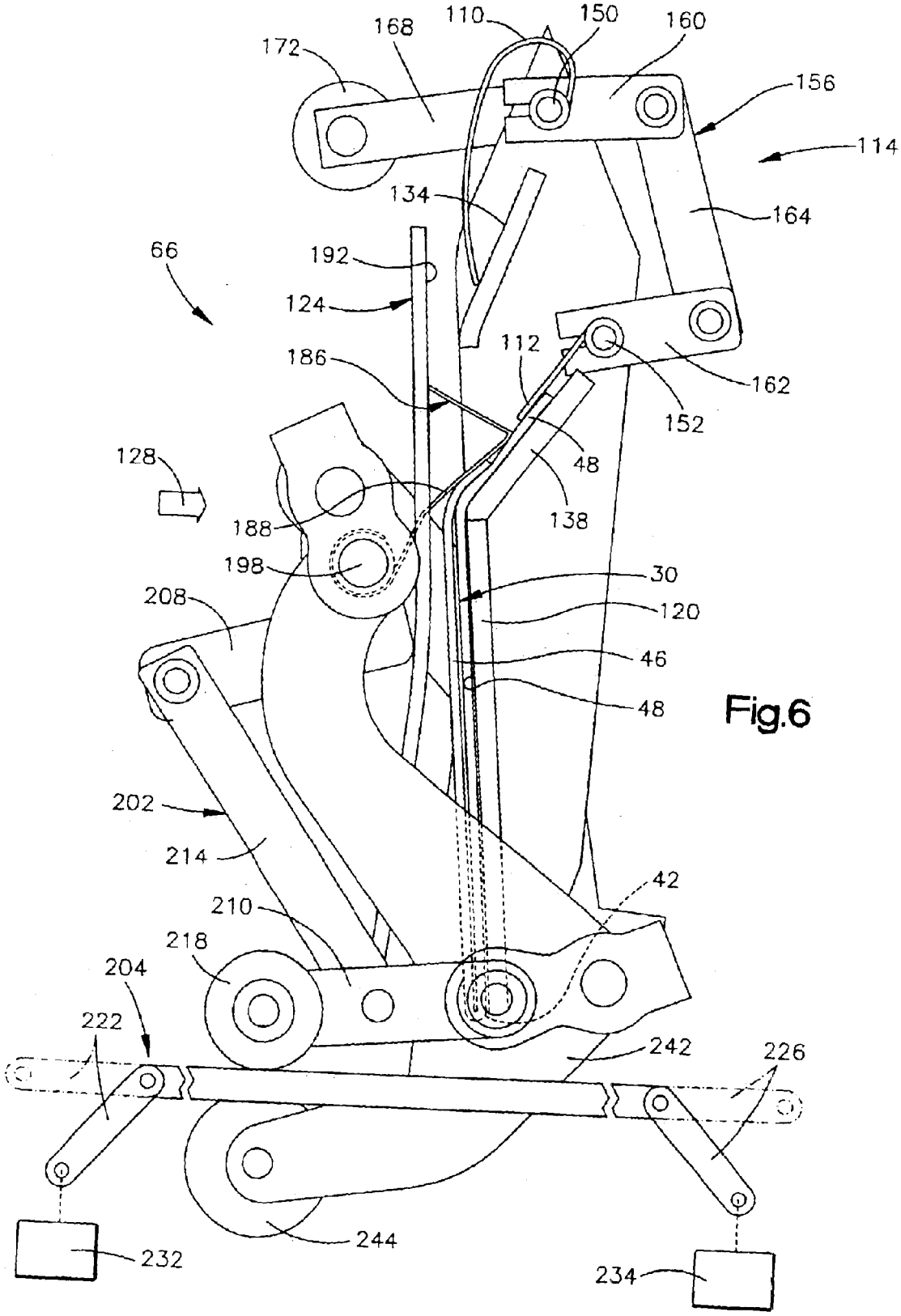
FIG. 6. is a simplified schematic side elevational view of the pocket assembly of FIG. 3 in a closed condition.
Figure 7:
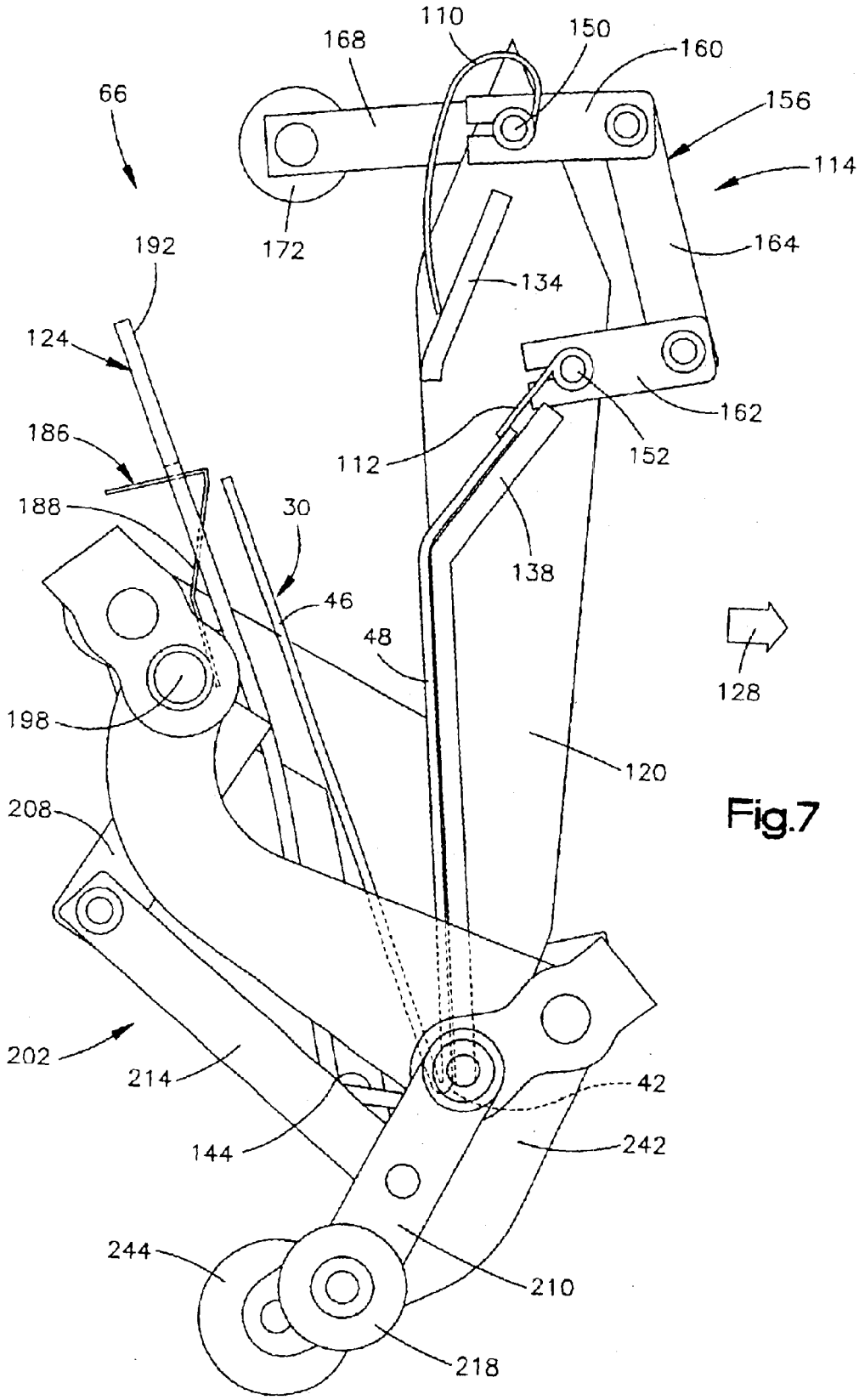
FIG. 7. is a simplified schematic side elevational view of the pocket assembly of FIG. 3 in an open condition.

Once the cover section 28 or 30 has been engaged by one of the grippers 110 or 112, the pocket assembly 66 is operated from the closed condition of FIG. 6 back to the open condition of FIG. 7. As this occurs, the front or headline section 36 or 46 (FIG. 2) of the jacket section 28 or 30 moves away from the back section or side 38 or 48 (FIG. 7). This opens the cover section 28 or 30 to enable sheet material inserts to be fed from item hoppers 78 (FIG. 1) into the open cover section.

Although only a single item hopper 78 is illustrated in FIG. 1, it should be understood that there are a plurality of item hoppers in an arcuate array about the center of the collator conveyor assembly 16. As the open pocket assembly 66 is moved beneath each of the item hoppers 78 in turn, a sheet material item or insert is fed into the open cover section 28 or 30 in the manner indicated by an arrow 40 or 50 in FIG. 2. As the pocket assembly 66 is moved relative to the stationary sheet material feed mechanism 62 by rotation of the collator conveyor 64, the pocket assembly is moved in the direction of an arrow 128 (FIG. 3) with the forward wall 120 of the pocket leading and the rearward wall 124 of the pocket assembly trailing.

When the pocket assembly 66 reaches the discharge station 84 (FIG. 1), the desired number of sheet material items or inserts will have been fed into the open cover section 28 or 30 to complete the construction of the newspaper. The lower end portion of the pocket assembly 66 is opened at the discharge station 84 to drop the newspaper downward to the delivery conveyor 22. To open the lower end portion of the pocket assembly 66 and drop the completed newspaper to the delivery conveyor 22, the rearward wall 124 (FIGS. 3 and 7) is pivoted about an axis adjacent to its upper section to move the lower portion of the rearward wall away from the main or forward wall 120. As this occurs, the bottom of the pocket assembly 66 opens and the completed newspaper is dropped from the pocket assembly.

The main or upper gripper 110 is movable from the open condition of FIGS. 3 and 5 to the closed condition of FIG. 6 to press an upper portion of the back section or side 38 of the relatively large jacket or cover section 28 (FIG. 2) against a main or upper shelf 134 (FIG. 3-6). The front or headline side 36 of the cover section 28 is not engaged by a main or upper gripper 110. This is because the height of the back section or side 38 of the cover section 28 is greater than the height of the front or headline side 36 of the cover section 28. The short front side 36 of the cover section 28 does not extend far enough upward to be engaged by the upper gripper 100. Therefore, when the pocket assembly 66 is operated from the closed condition of FIG. 6 to the open condition of FIG. 7, the cover section 28 opens to enable inserts to be positioned in the cover section.

The lower gripper 112 cooperates with a secondary or lower shelf 138 (FIGS. 4, 6 and 7) to grip an upper portion of the relatively small jacket or cover section 30. The relatively small jacket or cover section 30 has a height which is less than the height of the relatively large jacket or cover section 28. Therefore, the distance from a bottom or lower end portion 144 (FIGS. 4, 5, and 7) of the pocket assembly 66 to the secondary or lower gripper 112 and secondary or lower shelf 138 is less than the distance from the bottom of the pocket assembly to the main or upper gripper 110 and the main or upper shelf 134. The distance by which the main or upper gripper 110 and shelf 134 are spaced from the bottom or lower end portion 144 of the pocket assembly 66 exceeds the distance by which the secondary or lower gripper 112 and secondary or lower shelf 138 are spaced from the bottom or lower end portion of the pocket assembly as is a function of the difference in the height of the jacket or cover sections 28 and 30. Thus, the greater the height of the tall jacket or cover section 28 relative to the short jacket or cover section 30 (FIG. 2), the greater would be the distance from the bottom or lower end portion 144 of the pocket assembly 66 to the main or upper gripper 110 as compared to the distance to the secondary or lower gripper 112.

The secondary or lower gripper 112 is movable from the open condition of FIGS. 3 and 5 to the closed condition of FIG. 6 to press an upper portion of the back section or side 48 of the relatively small jacket or cover section 30 (FIG. 2) against a lower shelf 138 (FIG. 3-6). The front or headline side 46 of the cover section 28 is not engaged by the lower gripper 112. This is because the height of the back section or side 48 of the cover section 30 is greater than the height of the front or headline side 46 of the cover section 30. The short front side 46 of the cover section 30 does not extend far enough upward to be reached by the gripper 112. Therefore, when the pocket assembly 66 is operated from the closed condition of FIG. 6 to the open condition of FIG. 7, the cover section 30 opens to enable inserts to be positioned in the cover section.

The gripper operating assembly 114 (FIG. 4) simultaneously moves both of the grippers 110 and 112 from their open condition to their closed condition when either a relatively large jacket or cover section 28 or a relatively small jacket or cover section 30 is fed into the pocket assembly 66. The upper gripper 110 is mounted on an upper actuator shaft 150 (FIG. 4). Similarly, the lower gripper 112 is mounted on a lower actuator shaft 152.

The actuator shafts 150 and 152 extend parallel to each other and are rotatably mounted on the main or forward wall 120 of a pocket assembly 66. A linkage 156 (FIG. 4) interconnects the actuator shafts 150 and 152. The linkage 156 includes an upper arm 160 which is fixedly connected to the upper actuator shaft 150 and a lower arm 162 which is fixedly connected to the lower actuator shaft 152. A link 164 extends between and is pivotally connected with forward ends of the upper and lower arms 160 and 162.

An actuator arm 168 (FIGS. 3 and 4) is fixedly connected to the upper actuator shaft 150. A cam follower or roller 172 is rotatably mounted on a rearward end of an actuator arm 168. The cam follower or roller 172 is engagable with a cam track 176 (FIG. 3).

When the cam follower or roller 172 is disposed in engagement with the cam track 176, the grippers 110 and 112 are maintained in the open condition of FIGS. 3 and 5. As the cam follower or roller moves forward, that is in the direction of the arrow 128 in FIG. 3, the cam follower moves off of the track 176. When this occurs, suitable biasing springs (not shown) and the weight of the arm 168 and roller 172 pivot the actuator arm 168 in a counterclockwise direction (as viewed in FIG. 3). This results in counterclockwise rotation (as viewed in FIG. 5) of both the upper and lower actuator shafts 150 and 152.

This rotation of the actuator shafts 150 and 152 is effective to move the grippers 110 and 112 from the open condition of FIG. 5 to the closed condition of FIGS. 6 and 7. If the relatively large jacket or cover section 28 was fed from the jacket or cover section hopper 72 into the open pocket assembly 66, the gripper 110 presses the back section or side 38 against the upper shelf 134. Similarly, if the relatively small jacket or cover section 30 was feed into the open pocket assembly 66, the gripper 112 presses the back section or side 48 against the lower shelf 138.

Once the cover section 28 or 30 has been engaged by either the gripper 110 or 112, the pocket assembly 66 is operated from the closed condition of FIG. 6 to the open condition of FIG. 7. As this occurs, the cover section 28 or 30 is opened (FIG. 7). Sheet material items can be inserted into the open cover section 28 or 30 as it moves beneath the item hoppers 78.

The lower gripper 112 is shorter than the upper gripper 110. The relatively short length of the lower gripper 112 enables it to be operated between the open and dosed conditions without engaging the back section or side 38 of a relatively large cover section 28.

To enable the gripper 112 to engage a relatively small cover section 30, presser or pusher fingers 182, 184, and 186 (FIG. 5) are provided on the movable secondary or rearward wall 124 of the pocket assembly 66. The presser fingers 182, 184 and 186 are movable between extended and retracted positions. When the presser fingers 182–186 are in their retracted positions, they are ineffective to press against a relatively large cover section 28. However, when the presser fingers 182–186 are in their extended positions (FIG. 6), they are effective to press an upper portion of the relatively small cover section 30 against the lower shelf 138 as the pocket 66 is closed. When the upper portion of the relatively small cover section 30 has been pressed against the lower shelf 138, operation of the lower gripper 112 from the open condition to the closed condition (FIG. 6) results in the back section or side 48 of the relatively small cover section 30 being clamped between the lower gripper 112 and the lower shelf 138.

The presser finger 186 has a lower section 188 (FIG. 6) which extends generally parallel to the upper side of the lower shelf 138 when the presser finger 186 is in the extended position of FIG. 6. This enables the lower section 188 of the presser finger 186 to firmly press the relatively small cover section 30 firmly against the lower shelf 138. The presser fingers 182 and 184 have the same construction as the presser finger 186. Therefore, they are also effective to press the upper portion of the relatively small cover section 30 firmly against the lower shelf 138. This results in the upper portion of the relatively small cover section 30 being deflected so that it lays flat against the shelf and can be readily engaged by the relatively short lower gripper 112.

Although three presser fingers 182–186 are illustrated in FIG. 5, a greater or lesser number of presser fingers may be used if desired. For example, a single presser member may be substituted for the presser fingers 182–186. If this is done, the single presser member may extend across a major portion of the rearward wall 124 of the pocket assembly 66. If desired one or more sucker (vacuum) type grippers may be associated with the upper and lower shelves 134 and 138 to assist in gripping the back sections or side 38 or 48 of a cover section 28 or 30.

When the presser fingers 182–186 are in their retracted positions illustrated in FIG. 5, they project a short distance forward of a forwardly facing side surface 192 on the rearward wall 184 of the pocket assembly 66. The presser fingers 182–186 are formed of a resiliently deflectable material and are effective to apply force against the front or headline side 36 of a relatively large jacket 28 as the rearward wall 124 is pivoted toward the base or forward wall 120 of the pocket assembly 66. However, the presser fingers 182–186 extend only a short distance forward from the surface of the rearward wall 192 when the presser fingers are in the retracted position of FIG. 5. This enables the presser fingers to urge a relatively large cover section 28 toward the base or forward wall 120 without significantly deflecting the relatively large cover section 28 toward the lower shelf 138.

The presser fingers 182–186 are fixedly connected with a rocker or actuator shaft 198 (FIGS. 6 and 7). The rocker shaft 198 is pivotally mounted on the secondary or rearward wall 124 (FIG. 3) of the pocket assembly 66. An operator assembly 202 is actuatable by a control cam assembly 204 (FIG. 6) to rotate the rocker shaft 198 in a clockwise direction (as viewed in FIGS. 6 and 7) to move the presser fingers 182–186 (FIG. 5) from the retracted condition to the extended condition immediately prior to and as the pocket assembly 66 is operated from the open condition to the closed condition. This results in the presser fingers 182–186 being extended to press the relatively small jacket section 30 firmly against the lower shelf 138 as the pocket assembly 66 is operated to the closed condition of FIG. 6.

The presser finger operator assembly 202 includes an upper arm 208 which is fixedly connected to the rocker shaft 198. In addition, the operator assembly 202 includes a lower arm 210 which is pivotally connected to the main or forward wall 120 of the pocket assembly 66. A connector link 214 has an upper end which is pivotally connected with the upper arm 208 and a lower end which is pivotally connected with the lower arm 210. A cam follower or roller 218 is disposed on the left (as viewed in FIG. 6) end of the lower arm 210.

When the control cam assembly 204 is in the active condition of FIG. 6, the roller 218 is engagable with a first section 222 of the control cam assembly as the pocket assembly 66 moves toward the right as viewed in FIG. 6, that is, in a forward direction. As the roller 218 moves up the first section 222 of the control cam assembly 204, the lower arm 210 is pivoted in a clockwise direction relative to the base or forward wall 120 of the pocket assembly 66. As this occurs, the connector link 214 is moved upward from the position shown in FIG. 7 to the position shown in FIG. 6. This upward movement of the connector link 214 pivots the upper arm 208 and the rocker shaft 198 in a clockwise direction as viewed in FIGS. 6 and 7. Since the presser fingers 182–186 are fixedly connected with the rocker shaft 198, this moves the presser fingers from their retracted positions to their extended positions.

The extended presser fingers 182–186 are effective to press the upper portion of the relatively small cover section 30 firmly against the lower shelf 138 in the manner illustrated schematically in FIG. 6. Once this has occurred, the gripper operator assembly 114 (FIG. 3) is disengaged from the cam track 176 to effect pivotal movement of the grippers 110 and 112 from their open positions to their closed positions. As the lower gripper 112 moves to its closed position, it clamps the upper end of the portion of the back section or side 48 of the relatively small jacket 30 firmly against the lower shelf 138. Once this has occurred, continued forward movement, that is, the direction of the arrow 128 in FIG. 6, of the pocket assembly 66 moves the cam follower or roller 218 into engagement with a second section 226 of the control cam assembly 204. As this occurs, the lower arm 210 is pivoted in a counterclockwise direction (as viewed in FIG. 6). This moves the connector link 214 and upper arm 208 from the position illustrated in FIG. 6 to the position illustrated in FIG. 7 to again retract the presser fingers 182–186.

When the relatively large cover section 28 (FIG. 2) is utilized in association with the pocket assembly 66, the presser fingers 182–186 (FIGS. 3 and 5) are maintained in their retracted positions. Therefore, when a relatively large cover section 28 is to be used with the pocket assembly 66, the control cam assembly 204 is operated from the active condition illustrated in solid lines in FIG. 6 to an inactive condition illustrated in dashed lines in FIG. 6. When the control cam assembly 204 is in the inactive condition, the cam follower 218 does not engage the control cam assembly 204 during movement of the pocket assembly 66 along the control cam assembly. Therefore, the presser finger operator assembly 202 remains in the unactuated condition of FIGS. 3 and 7.

To operate the control cam assembly 204 to the inactive condition, a pair of solenoids 232 and 234 are operated to pivot the first and second sections 222 and 226 of the control cam assembly 224 upward (as viewed in FIG. 6). When the first and second sections 222 and 226 of the control cam assembly 224 have been moved to their inactive conditions illustrated in dash lines in FIG. 6 by the solenoids 232 and 234, the cam follower or roller 218 on the lower arm of the operator assembly 202 moves beneath the control cam assembly 204. Therefore, the lower arm 210 remains in the position illustrated in FIG. 7 and the presser fingers 182–186 remain in their retracted positions as the pocket assembly 66 moves along the control cam assembly 204. If desired, the cam track 176 may be constructed so as to operate between active and inactive conditions, in the same manner as the control cam assembly 204.

It should be understood that the control cam assembly 204 may be operated between its active and inactive condition in ways other than using solenoids 232 and 234. For example, the first and second sections 222 and 226 may be manually pivoted from their active positions (shown in solid lines in FIG. 6) to their inactive positions (shown in dashed lines in FIG. 6). Alternatively, screw drive assemblies may be used to pivot the first and second sections 222 and 226 of the control cam assembly 204 between their active and inactive positions.

The pocket assembly 66 is operated between the open condition of FIGS. 5 and 7 and the closed condition of FIG. 6, in a known manner, by an operator assembly 240 (FIG. 3). The operator assembly 240 includes an arm 242 which is fixedly connected to the secondary or rearward wall 124 of the pocket assembly. A roller or cam follower 244 on the arm 242 is engagable with a cam 246. Engagement of the arm 244 with the cam 246 pivots the arm 242 upward (as viewed in FIG. 3) to rotate the upper end portion of the secondary or rearward wall 124 toward the base or forward wall 120. As this occurs, the secondary or rearward wall pivots about its lower end portion in a direction toward the base or forward wall 120. This effects operation of the pocket assembly 66 from the open condition to the closed condition. It should be understood that the pocket 66 may be opened in any one of many known ways.

Operation

When a relatively large newspaper is to be assembled, the jacket or cover section hopper 72 (FIG. 1) is loaded with a supply of relatively large cover sections 28 (FIG. 2). The item hoppers 78 are loaded with items which are sized to be received in a relatively large cover section 28 fed from the jacket or cover section hopper 72 into a pocket assembly 66 in the rotor 64. The rotor 64 is then operated to sequentially move each of the pocket assemblies 66 in along a circular path past the jacket or cover section hopper 72 and then past the item hoppers 78.

As the rotor 64 moves a pocket assembly 66 (FIG. 3) past the jacket or cover section hopper 72, the pocket assembly is in an upwardly opening condition (FIGS. 3–5) to enable a cover section 28 to be fed into the hopper 66. At this time, the grippers 110 and 112 are in their open conditions and the presser members 182–186 are in their retracted positions. To maintain the pocket assembly 66 in the open condition, the cam follower or roller 244 (FIG. 3) is spaced from the cam track 246 as the pocket assembly 66 moves beneath the cover section hopper 72. The grippers 110 and 112 are maintained in the open condition by engagement of the cam follower 172 with the cam track 176.

As a cover section 28 is fed from the hopper 72 into the open pocket assembly 66, the folded lower edge portion 32 (FIG. 2) of the cover section engages the closed bottom or lower portion 144 (FIG. 5) of the open pocket assembly. Immediately after the cover section 30 has been fed into the open pocket assembly 66, the roller or cam follower 244 (FIG. 3) engages the cam 246. This causes the movable rearward wall 124 of the hopper assembly 66 to begin pivoting toward the base or forward wall 120 of the hopper assembly. As this occurs, the gripper cam follower or roller 172 (FIG. 3) begins to move off of the cam track 176. Therefore, as the pocket assembly 66 is operated from the open condition to the closed condition, the grippers 110 and 112 are simultaneously operated from their open conditions to their closed conditions by the gripper operator assembly 114.

At this time, the relatively large jacket section 28 (FIG. 2) is disposed in the pocket assembly 66. Therefore, the presser fingers 182–186 (FIGS. 3 and 5) are maintained in their retracted positions. To maintain the presser fingers 182–186 in their retracted positions, the solenoids 232 and 234 (FIG. 6) are operated to move the first and second sections 222 and 226 of the control cam assembly 204 upward (as viewed in FIG. 6) to their inactive positions. Therefore, as the pocket assembly 66 is moved past the control cam assembly 204, the roller or cam follower 218 does not engage the control cam assembly 204. This results in the operator assembly 202 remaining in the unactuated condition of FIGS. 3 and 7. Therefore, the presser fingers 182–186 remain in their retracted conditions.

After the main or upper gripper 110 has engaged the upper end portion of the back section or side 38 of the relatively large cover section 28, the roller or cam follower 244 (FIG. 3) moves out of engagement with the cam 246. As this occurs, the pocket assembly 66 is operated from the closed condition of FIG. 6 to the open condition of FIG. 7. As the pocket assembly 66 moves to the open condition of FIG. 7, the jacket or cover section 28 is opened.

As the rotor 64 continues to move the open pocket assembly 66 past each of the item hoppers 78 in turn, sheet material items are sequentially fed into the open jacket section 28. When the desired number of items have been inserted to the open cover section and the jacket assembly approaches the discharge station 84, the gripper cam follower or roller 172 (FIG. 3) again engages the cam track 176 and the grippers 110 and 112 are operated to their open positions. At the same time a cam (not shown) actuates the pocket assembly 66 to open the bottom or lower end portion 144 of the pocket assembly 66 in a known manner. This results in a completed newspaper being dropped from the pocket assembly downward at the discharge station 84 to an open gripper 90 of the delivery conveyor 22.

When the collator conveyor assembly 16 (FIG. 1) is to be used to form a relatively small newspaper which utilizes a relatively small jacket or cover section 30 (FIG. 2), the jacket or cover section hopper 72 (FIG. 1) is loaded with the relatively small jacket or cover sections 30 (FIG. 2). The item hoppers 78 (FIG. 1) are loaded with items which are sized to fit within the relatively small cover section 30. Although only a single item hopper 78 has been illustrated in FIG. 1, it should be understood that there are a plurality of item hoppers disposed in an arcuate array about the center of the stationary sheet material in feed mechanism 62.

Rotation of the rotor 64 sequentially moves the pocket assemblies 66 to a loading position beneath the jacket or cover section hopper 72. As a pocket assembly 66 moves to a loading position beneath the jacket or cover section hopper 72, the pocket assembly is in the open condition of FIG. 3. Therefore, the cam follower 244 (FIG. 3) is spaced from the cam 246 as a pocket assembly 66 moves beneath the jacket or cover section hopper 62.

At this time, the gripper cam follower or roller 172 is disposed in engagement with the cam track 176 (FIG. 3). Therefore, the grippers 110 and 112 are in their open conditions. The presser finger cam follower 218 is spaced from the control cam assembly 204. Therefore, the presser fingers 182–186 are in their retracted positions.

A relatively small jacket section 30 is fed from the jacket or cover section hopper 72 by the sheet material feed mechanism 74 into the open pocket assembly 66 as the pocket assembly moves beneath the jacket or cover section hopper. The folded or dosed lower edge portion 142 of the small cover section 30 engages the lower end portion 144 (FIG. 5) of the open pocket assembly 66. This positions the upper edge portion 44 of the small cover section relative to the lower gripper 112.

As the rotor 64 continues to move the in the direction of the arrow 128 (FIGS. 1 and 3) relative to the stationary hoppers 72 and 78, the roller or cam follower 244 (FIG. 3) begins to move into engagement with the cam 246. This initiates operation of the pocket assembly 66 from the open condition of FIGS. 3 and 5 toward the closed condition of FIG. 6. At the same time, the presser finger roller or cam follower 218 (FIG. 6) moves into engagement with the control cam assembly 204.

At this time, the control cam assembly 204 is in the active condition illustrated in solid lines in FIG. 6. Therefore, the control cam assembly 204 is effective to pivot the lower arm 210 relative to the main or forward wall 120 of the pocket assembly 66. This effects movement of the presser fingers 182–186 from their retracted positions to their extended positions.

As the pocket assembly 66 continues to close with the presser fingers 182–186 in their extended positions, the upper end portion of the relatively small jacket section 30 is pressed against the secondary or lower shelf 138 by the extended presser fingers. After the upper end portion of the jacket section 30 has been pressed against the secondary or lower shelf 138 by the presser fingers 182–186, the gripper cam follower or roller 172 (FIG. 3) moves out of engagement with the cam track 176. This results in the grippers 110 and 112 being operated from their open conditions to their closed conditions. As this occurs, the upper end portion of the back section or side 48 (FIG. 2) of the relatively small cover section 30 is pressed firmly against the secondary or lower shelf 138 (FIG. 6) by the lower gripper 112.

After the back section or side 48 of the relatively small jacket section 30 has been firmly clamped between the lower gripper 112 and the lower shelf 138, the cam follower or roller 244 (FIG. 3) begins to move out of engagement with the cam 246 to initiate operation of the pocket assembly 66 to the open condition. At the same time, the presser finger roller or cam follower 218 begins to move into engagement with the second section 226 (FIG. 6) of the control cam assembly 204. This initiates movement of the presser fingers 182–186 from their extended positions toward their retracted positions. It should be understood that the cam follower or roller 172 remains in engagement with the cam track 176 so that the lower gripper 112 continues to grip the back side or section 48 of the relatively small cover section 30.

As the pocket assembly 66 continues to move forward, that is in the direction of the arrow 128 in FIG. 3, the movable rearward wall 124 of the pocket assembly pivots about its lower end portion 144 in a direction away from the main or forward wall 120 of the pocket assembly. As this occurs, the presser fingers 182–186 move to their retracted positions. As the pocket assembly 66 opens, the relatively small jacket section 30 opens. As the open pocket assembly 66 and cover section 30 are moved beneath each of the item hoppers 78 in turn, sheet material items are sequentially fed from the item hopper into the open cover section.

As the open pocket assembly 66 approaches the discharge station 84, the gripper cam follower 172 (FIG. 3) moves out of engagement with the cam track 176. This results in the lower gripper 112 being operated from its closed position to its open position. At the discharge station 84, the bottom or lower end portion 144 of the pocket assembly is opened to drop the completed newspaper downward toward the delivery conveyor 22.

In the foregoing description, the collator conveyor assembly 16 has been used to form relatively large newspapers having relatively large jacket or cover sections 28. After the relatively large newspapers have been formed, the collator conveyor assembly 16 may be used to form newspapers having relatively small jacket or cover sections 28. The same pocket assemblies 66 are used to form relatively large and relatively small newspapers without adjustment of the pocket assemblies.

It is contemplated that a single collator conveyor assembly 16 may be used to simultaneously form both relatively small and relatively large newspapers. For example, two jacket or cover section hoppers 72 may be provided adjacent to each other. Relatively large jacket or cover sections 28 would be fed into every second pocket assembly 66 from a first one of the jacket or cover section hoppers 72. Relatively small jacket or cover sections 30 would be fed from the second cover section hopper into the pocket assemblies 66 which did not receive a large jacket or cover section from the first jacket or cover section hopper 72.

With this arrangement every second item feed hopper 78 would be loaded with sheet material items to be fed into a large jacket or cover section 28. The other item feed hoppers 78 would be loaded with sheet material items to be fed into a small jacket or cover section 30. Each of the item feed hoppers 78 would be enabled to feed into every other pocket assembly 66 passing beneath the item feed hopper. Of course, the item feed hoppers 78 containing items for a large newspaper would be enabled to feed into the pocket assemblies 66 containing a large jacket or cover section 28. Similarly, the item feed hoppers 78 containing items for a small newspaper would be enabled to feed into pocket assemblies containing a small jacket or cover section 30.

Alternatively, the collator conveyor assembly 16 may be provided with two cover section hoppers 72 which are spaced 180 degrees apart about the circumference of the stationary sheet material in feed mechanism 62. Relatively large jacket or cover sections 28 would be fed into each of the pocket assemblies 66 in turn as they moved beneath a first one of the jacket or cover section hoppers 72. Relatively small jacket or cover sections 30 would be fed into each of the pocket assemblies 66 in turn as they moved beneath the second one of the jacket or cover section hoppers 72.

The item feed hoppers 78 disposed between the first and second jacket or cover section hoppers 72 and downstream from the first cover section feed hopper would feed sheet material items for a relatively large newspaper. A first discharge station 84 would be provided immediately ahead of the second cover section feed hopper. Relatively large newspapers would be transferred from the pocket assemblies 66 to a first delivery conveyor 22 at the first discharge station.

The item feed hoppers 78 disposed between the first and second jacket or cover section hoppers 72 and downstream from the second cover section feed hopper would feed sheet material items for a relatively small newspaper. A second discharge station 84 would be provided immediately ahead of the first cover section feed hopper. Relatively small newspapers would be transferred from the pocket assemblies 66 to a second delivery conveyor 22 at the second discharge station.

CONCLUSION

In view of the foregoing description, it is apparent that the present invention provides a new and improved apparatus 16 for use in forming sheet material assemblages of different heights. The sheet material assemblages include a folded cover section 28 or 30 into which other sheet material items are inserted. The cover section 28 for tall sheet material assemblages have a greater height than the cover sections 30 for short sheet material assemblages.

The apparatus 16 includes a pocket assembly 66 which is sequentially movable past a plurality of sheet material of feeders 72 and 78. The pocket assembly 66 includes a an upper gripper 110 for gripping a tall cover section 28 and a lower gripper 112 for gripping a short cover section 30. The upper gripper 110 is spaced further from the bottom 144 of the pocket assembly 66 than is the lower gripper 112.

It should be understood that the present invention includes a plurality of different features. These features may be used in association with each other in the manner disclosed in the present application. Alternatively, the features may be used separately or in combination with features of the prior art.

Although the foregoing description was in conjunction with the forming of one specific type of sheet material assemblage, that is, a newspaper, the present invention may be used in conjunction with the forming of other types of sheet material assemblages. For example, the present invention may be used in conjunction with the forming of booklets, pamphlets, signatures, or other sheet material assemblages.

Having described the invention, the following is claimed:

1. An apparatus for use in forming sheet material assemblages which include a folded cover section having two sides and into which other sheet material items are inserted, said apparatus comprising;

a pocket assembly which is sequentially movable past a folded cover section feeder and a plurality of sheet material item feeders, said pocket assembly including forward and rear walls defining a pocket into which a folded cover section is fed and a mechanism for opening folded cover sections of different sizes to receive sheet material items fed by the sheet material item feeders;

said mechanism for opening folded cover sections of different sizes comprising a first gripper for gripping one side of a folded cover section of one size, and a second gripper spaced apart from said first gripper for gripping one side of a folded cover section of a different size, said first gripper being ineffective to grip said folded cover section of a different size, said second gripper being ineffective to grip said folded cover section of one size.

2. An apparatus as set forth in claim 1 further including an operator assembly connected with said first and second grippers to operate said first and second grippers during forming of sheet material assemblages of the one size and during forming of sheet material assemblages of the different size.

3. An apparatus as set forth in claim 1 further including a presser which is connected with a first one of said forward and rear walls and is effective to press a side of a folded cover section against a second one of said forward and rear walls, said presser being movable with said first one of said forward and rear walls relative to said second one of said forward and rearward walls.

4. An apparatus as set forth in claim 3 further including an operator assembly which is connected with said presser and is operable to effect movement of said presser relative to said first one of said forward and rear walls to move said presser between a retracted condition and an extended condition, said presser being effective to urge the one side of the folded cover section toward said second gripper when said presser is in the extended condition.

5. An apparatus as set forth in claim 4 further including an actuator which is operable between an active condition and an inactive condition, said actuator being effective to effect operation of said operator assembly to move said presser when said actuator is in the active condition, said actuator being ineffective to effect operation of said operator assembly when said actuator is in the inactive condition.

6. An apparatus for use in forming sheet material assemblages of different sizes, said apparatus comprising:

a pocket assembly which is sequentially movable past a plurality of sheet material feeders, said pocket assembly including a base and a sheet material support portion which is connected with said base and is engagable with a folded portion of a cover section of a sheet material assemblage with opposite sides of the cover section extending upward from the folded portion of the cover section, a first gripper connected with said base and spaced a first distance from said sheet material support portion to engage an upper edge portion of one side of a cover section of a first sheet material assemblage having a relatively large distance between a folded portion and an upper edge portion of the cover section of the first sheet material assemblage, and a second gripper connected with said base and spaced a second distance from said sheet material support portion to engage an upper edge portion of one side of a cover section of a second sheet material assemblage having a relatively small distance between a folded portion and an upper edge portion of the cover section of the second sheet material assemblage, said first distance being greater than said second distance.

7. An apparatus as set forth in claim 6 wherein said pocket assembly includes a side section which is movable relative to said base to operate said pocket assembly between open and closed conditions, and a presser which is movable with said side section, said presser being engagable with the cover section of the second sheet material assemblage to press the cover section of the second sheet material assemblage against said base.

8. An apparatus as set forth in claim 7 wherein said presser is movable relative to said side section between a retracted position and an extended position in which said presser extends from said side section toward said base section, said apparatus further includes an operator assembly connected with said presser and an actuator which effects operation of said operator assembly to move said presser between the retracted and extended positions.

9. An apparatus as set forth in claim 8 further including a first base surface area against which a portion of a cover section of a sheet material assemblage having a relatively large distance between the folded portion and the upper edge portion is pressed by said first gripper and a second base surface area against which a portion of a cover section of a sheet material assemblage having a relatively small distance between the folded portion and the upper edge portion is pressed by said second gripper, said presser being effective to urge a cover section against at least said one of said first and second base surface areas.

10. An apparatus as set forth in claim 8 further including a first base surface area against which a portion of a cover section of a sheet material assemblage having a relatively large distance between the folded portion and the upper edge portion is pressed by said first gripper and a second base surface area against which a portion of a sheet material assemblage having a relatively small distance between the folded portion and the upper edge portion is pressed by said second gripper, said presser being effective to urge a cover section against said second base surface area.

11. An apparatus as set forth in claim 8 further including an actuator which is operable between an active condition in which said actuator is effective to effect operation of said operator assembly to move said presser and an inactive condition in which said actuator is ineffective to effect operation of said operator assembly to move said presser.

12. An apparatus as set forth in claim 11 further including a device for operating said actuator between the active condition and the inactive condition, said actuator being in the inactive condition when a sheet material assemblage having a cover section with a relatively large distance between the folded portion and the upper edge portion of the cover section is to be formed in said pocket assembly, said actuator being in the active condition when a sheet material assemblage having a cover section with a relatively small distance between the folded portion and the upper edge portion of the cover section is to be formed in said pocket assembly.

13. An apparatus as set forth in claim 6 further including a first actuator for effecting operation of said first gripper between first and second conditions, said first gripper being effective to press a portion of a cover section having a relatively large distance between a folded portion and an upper edge portion against a first gripper surface connected with said base when said first gripper is the first condition during the forming of a sheet material assemblage having a relatively large distance between the folded portion and the upper edge portion of the cover section, said first gripper being ineffective to press a portion of a cover section against said first gripper surface when said first gripper is in the second condition, and a second actuator for effecting operation of said second gripper between first and second conditions, said second gripper being effective to press a portion of a cover section having a relatively small distance between a folded portion and an upper edge portion against a second gripper surface connected with said base when said second gripper is in the first condition during the forming of a sheet material assemblage having a relatively small distance between the folded portion and the upper edge portion of the cover section, said second gripper being ineffective to press a portion of a cover section against said second gripper surface when said second gripper is in the second condition.

14. An apparatus as set forth in claim 13 wherein said first and second grippers are simultaneously operated between their first and second conditions by said first and second actuators during the forming of sheet material assemblages having a relatively small distance between the folded portion and the upper edge portion of the sheet material assemblage assemblages.

15. An apparatus as set forth in claim 6 further including a first shaft connected with said first gripper and rotatably mounted on said base, a second shaft connected with said second gripper and rotatably mounted on said base, and a linkage connected with said first and second shafts to move said first and second shafts during the forming of a sheet material assemblage having a relatively large distance between the folded portion and the upper edge portion of the cover section and during the forming of sheet material assemblages having a relatively small distance between the folded portion and the upper edge portion of the cover section.

16. An apparatus for use in forming sheet material assemblages of different sizes, said apparatus comprising:

a pocket assembly which is sequentially movable past a plurality of sheet material feeders, said pocket assembly includes a base, a first gripper connected with said base to engage an upper edge portion of one side of a cover section of a first sheet material assemblage, a second gripper connected with said base to engage an upper edge portion of one side of a cover section of a second sheet material assemblage, said cover section for said first sheet material assemblage being larger than said cover section for said second sheet material assemblage, said pocket assembly includes a side section which is movable relative to said base to operate said pocket assembly between open and closed conditions, and a presser which is movable with said side section relative to said base, said presser being engagable with the cover section of said second sheet material assemblage to press the cover section of said second sheet material assemblage against said base.

17. An apparatus as set forth in claim 16 wherein said presser is movable relative to said side section between a retracted position and an extended position in which said presser extends from said side section toward said base section, said apparatus further includes an operator assembly connected with said presser and an actuator which effects operation of said operator assembly to move said presser between the retracted and extended positions.

18. An apparatus as set forth in claim 16 wherein said presser is operable to press the cover section of said second sheet material assemblage against a surface area disposed on said base adjacent to said second gripper, said presser being ineffective to press the cover section of said first sheet material assemblage against said surface area disposed on said base adjacent to said second gripper.

19. An apparatus as set forth in claim 16 further including a first base surface area against which a portion of said cover section for said first sheet material assemblage is pressed by said first gripper and a second base surface area against which a portion of said cover section for said second sheet material assemblage is pressed by said second gripper, said presser being effective to urge a cover section against said second base surface area.

20. An apparatus as set forth in claim 16 further including an actuator connected with said presser, said actuator is operable between an active condition in which said actuator is effective to move said presser and an inactive condition in which said actuator is ineffective to move said presser.

21. An apparatus as set forth in claim 20 further including a device for operating said actuator between the active condition and the inactive condition, said actuator being in the inactive condition when the first sheet material assemblage is to be formed in said pocket assembly, said actuator being in the active condition when the second sheet material assemblage is to be formed in said pocket assembly.

22. An apparatus as set forth in claim 16 further including a first actuator for effecting operation of said first gripper between first and second conditions, said first gripper being effective to press a portion of said cover section of said first sheet material assemblages against a first gripper surface connected with said base when said first gripper is the first condition during forming of the first sheet material assemblage, said first gripper being ineffective to press a portion of the cover section of said second sheet material assemblage against said first gripper surface when said first gripper is in the second condition, and a second actuator for effecting operation of said second gripper between first and second conditions, said second gripper being effective to press a portion of said cover section of said second sheet material assemblage against a second gripper surface connected with said base when said second gripper is in the first condition, said second gripper being ineffective to press a portion of the cover section of said first sheet material assemblage against said second gripper surface when said second gripper is in the second condition.

23. An apparatus as set forth in claim 22 wherein said first and second grippers are simultaneously operated between their first and second conditions by said first and second actuators.

24. An apparatus as set forth in claim 16 further including a first shaft connected with said first gripper and rotatably mounted on said base, a second shaft connected with said second gripper and rotatably mounted on said base, and a linkage connected with said first and second shafts to move said first and second shafts during the forming of sheet material assemblages.

* * * * *